US007043943B2

(12) United States Patent
Koopmann et al.

(10) Patent No.: US 7,043,943 B2
(45) Date of Patent: May 16, 2006

(54) HIGH HEAT FILTER FABRIC AND METHOD

(75) Inventors: Daniel L. Koopmann, Janesville, WI (US); Cecil V. Kaylor, Gray, TN (US); Frances Mielke, Janesville, WI (US)

(73) Assignee: Monterey Mills, Janesville, WI (US)

( * ) Notice: Subject to any disclaimer, the term of this patent is extended or adjusted under 35 U.S.C. 154(b) by 0 days.

(21) Appl. No.: 11/047,273

(22) Filed: Jan. 31, 2005

(65) Prior Publication Data

US 2005/0274152 A1 Dec. 15, 2005

Related U.S. Application Data

(63) Continuation-in-part of application No. 10/866,577, filed on Jun. 12, 2004.

(51) Int. Cl.
*D04B 11/04* (2006.01)

(52) U.S. Cl. ..... 66/194

(58) Field of Classification Search ..... 66/202, 66/190, 191, 192, 193, 194; 442/312, 313, 442/314

See application file for complete search history.

(56) References Cited

U.S. PATENT DOCUMENTS 1,719,741 A * 7/1929 Winning ..... 248/27.1
2,964,932 A 12/1960 Rose
3,010,297 A 11/1961 Hill
3,299,672 A 1/1967 Schmidt
3,413,823 A 12/1968 Beucus et al.
3,427,829 A 2/1969 Wiesinger
3,709,002 A 1/1973 Brandt et al.
3,853,680 A * 12/1974 Daniel ..... 428/95
3,896,636 A 7/1975 Thore
3,896,637 A 7/1975 Thore
3,918,273 A 11/1975 Thore
4,006,610 A 2/1977 Thore
4,050,267 A 9/1977 Schaab et al.
4,172,165 A 10/1979 Kieckhefer et al.
4,244,198 A 1/1981 Schaab et al.
4,513,042 A 4/1985 Lumb
4,592,213 A 6/1986 Tilson et al.
4,840,838 A 6/1989 Wyss
4,966,800 A * 10/1990 Maix ..... 428/97
5,130,134 A 7/1992 Noddin et al.
5,171,339 A 12/1992 Forsten
5,181,945 A 1/1993 Bodovsky
5,230,226 A 7/1993 Saarikettu
5,429,864 A 7/1995 Samuels
5,431,029 A 7/1995 Kuhrau et al.
5,460,016 A 10/1995 Kuhrau et al.
5,497,531 A 3/1996 Kuhrau et al.
5,546,768 A 8/1996 Kuhrau et al.
5,577,402 A 11/1996 Kuhrau et al.

(Continued)

*Primary Examiner*—Danny Worrell
(74) *Attorney, Agent, or Firm*—Reinhart Boerner Van Deuren s.c.

(57) ABSTRACT

A fabric is disclosed which is suitable for use in the manufacture of particulate filters for use in high heat environments having a high airflow requirement, together with a method for making the high heat filter fabric. The filter fabric has a sliver knit pile construction, and may be manufactured on conventional knitting machines. Both the yarn used in the backing of the high heat filter fabric and the fibers used for the pile of the high heat filter fabric are made of aramid materials, and the high heat filter fabric is suitable for use in high temperatures such as those associated with coal-fired power plants.

38 Claims, 2 Drawing Sheets

U.S. PATENT DOCUMENTS 5,685,176 A 11/1997 Kuhrau et al.
5,806,154 A 9/1998 Tolbert
5,809,804 A 9/1998 Kuhrau et al.
5,925,581 A 7/1999 Tolbert
6,041,482 A 3/2000 Zhu et al.
6,151,920 A 11/2000 Schindler et al.
6,477,865 B1 * 11/2002 Matsumoto ..... 66/195
6,630,414 B1 * 10/2003 Matsumoto ..... 442/1
6,739,161 B1 * 5/2004 Ohara et al. ..... 66/194
2003/0175475 A1 9/2003 Higgins et al.

* cited by examiner

HIGH HEAT FILTER FABRIC AND METHOD

This patent application is a continuation-in-part of copending U.S. patent application Ser. No. 10/866,577, filed on Jun. 12, 2004, entitled "High Heat Filter Fabric and Method," which patent application is assigned to the assignee of the present invention, and which patent application is hereby incorporated herein by reference in its entirety.

BACKGROUND OF THE INVENTION

Field of the Invention

The present invention relates generally to filters for particulates, and more particularly to a new fabric for use in filter media which is capable of use in high heat environments having a high airflow requirement and a method for making this new high heat filter fabric.

As industrialized countries increasingly seek to limit air pollution, the standards for emissions have become increasingly stringent. At the same time, with the demand for electricity continuing to rise and the limited use of emission-free nuclear power plants, the use of fossil fuels including coal has continued to increase. Coal-fueled power plants present a particular problem, with the particulates being contained in emissions which are at a relatively high temperature.

While such emissions have in the past generally been treated with electrostatic precipitators, the increasingly stringent emission standards are driving a replacement of the precipitators with fabric filters. There are several factors in the new air quality standards which are increasing the desirability of fabric filters. The first of these is the new ambient standards for fine particulates (particulates which are 2.5 microns in diameter and smaller). Recent U.S. Environmental Protection Agency regulations will require power plants to reduce such emissions in the years from 2008 to 2013.

Pulse-jet filters use nonwoven fabrics and membranes which are capable of withstanding temperatures of 400 degrees Fahrenheit. There is a strong potential for filter media which is capable of use in even higher ambient temperatures, from 450 degrees Fahrenheit to approximately 850 degrees Fahrenheit. At such temperatures, the filter media can be used in the exhaust air flow ahead of a catalytic converter, which is used to reduce $NO_x$. This would be highly advantageous since catalytic converters are subject to plugging, and the elimination of particulates, including fine particulates, upstream of the catalytic converter would increase catalytic converter life and decrease capital costs.

Another requirement is that power plants further reduce the levels of $SO_2$ emissions, with this requirement being even more stringent with regard to regulations relating to power plants which are located near to national parks. Reduction of these emissions is best accomplished through the use of dry scrubber and fabric filter emission abatement systems. One technique which is used involves the injection of lime into the hot gas stream, which results in gypsum powder which must be removed from the hot gas stream. This is best accomplished through the use of fabric filters in pulse-jet filters.

Two other regulatory factors also indicate the use of fabric filters in power plant emissions control. The first factor is the increasingly stringent regulatory requirements for the elimination of mercury emissions, which is accomplished by injecting activated carbon particles into the hot gas stream and then using a fabric filter to remove the mercury which is entrained by the carbon particles. The second is regulatory requirements to limit the emission of toxic metals, including lead, cadmium, arsenic, chromium, and other toxic metals. These regulations require the use of the best available control technology (BACT), which at the present time is the use of fabric filters which remove toxic metals in the course of removing fine particulates from the hot gas stream.

Other industries are also turning increasingly to the use of fabric filters to treat hot gas streams and remove fine particulates from such hot gas streams. For example, the steel industry is also experiencing a significant increase in the use of fabric filters to remove fine particulates from hot gas streams. The waste incineration industry, which is increasing as the use of landfills is decreased, is also being required to remove acid gases, mercury, dioxins, and dust. The use of both lime injection and activated carbon injection together with fabric filters in the hot gas stream is viewed as the best manner in which to filter the exhaust gases.

While it will thus be appreciated that there exists a tremendous need for fabric filter media which can operate in a high temperature gas stream, there also exists a strong need for a fabric filter media in other applications which is capable of efficiently removing fine particulates from a gas stream. This includes a wide variety of industries and fine particulate generators ranging from shot blast equipment to textile manufacturing plants, with gas streams to be treated ranging in temperature from ambient temperature to relatively high temperatures (approximately 300 to 350 degrees Fahrenheit). All of these industries also represent potential markets for an efficient filter fabric capable of removing fine particulates and operating at a wide range of temperatures.

While the prior art has sought fabrics which are nonflammable, and includes a number of different approaches to producing fabrics which are nonflammable, there is strong unremedied need in the filter fabric area for a filter fabric which is capable of operating at a high ambient temperature. While most of the prior art dealt with the treatment of fabrics to make them fire-resistant, a few prior art references have dealt with the manufacture of a fabric which is inherently fire-resistant.

One example of such an approach is found in U.S. Pat. No. 4,513,042, to Lumb, which is hereby incorporated herein by reference. Lumb discloses a knit fabric which is made using a flame retardant aramid yarn with a pile made of flame retardant rayon fibers and superwashed wool fibers. The Lumb fabric is used as for the manufacture of fire-resistant cold weather gear for firefighter and military applications. However, the Lumb fabric is not suitable for use as a filter fabric, and is designed for transient protection against flame (for a matter of 16 to 37 seconds as disclosed in Lumb), and is simply not suitable for operation in a high ambient temperature environment where temperatures are typically in excess of 400 degrees Fahrenheit.

It is accordingly the primary objective of the present invention that it provide a filter fabric material which is suitable for use in dust and/or particulate filters that will be used in high temperature ambient operating environments. It is a closely related objective of the high heat filter fabric of the present invention that it be highly efficient as a filter medium at the removal of fine particulates which are as small as or possibly even smaller than 2.5 microns. It is another related objective of the high heat filter fabric of the present invention that it be capable of continuous operation in an environment wherein the ambient temperature is typically in excess of 400 degrees Fahrenheit.

In is an additional objective of the high heat filter fabric of the present invention that it also be capable of operating in high temperature environments without experiencing any significant degradation of the filter fabric material. It is a further objective of the high heat filter fabric of the present invention that it be reusable after periodic cleaning to remove particulates which have been trapped by the filter medium. It is yet another objective of the high heat filter fabric of the present invention that it work as a filter medium with any of a wide variety of different high temperature air pollution abatement technologies, including (but not limited to) both lime injection and activated carbon injection. It is still another objective of the high heat filter fabric of the present invention that it provide a sufficiently high degree of airflow therethrough to function properly in high airflow environments.

The high heat filter fabric of the present invention must also be both durable and long lasting, so that filter bags made from the fabric of the present invention will require little or no maintenance to be provided by the user throughout their operating lifetime. In order to enhance the market appeal of the high heat filter fabric of the present invention, it should also be of relatively inexpensive construction to thereby afford it the broadest possible market. Finally, it is also an objective that all of the aforesaid advantages and objectives of the high heat filter fabric of the present invention be achieved without incurring any substantial relative disadvantage.

SUMMARY OF THE INVENTION

The disadvantages and limitations of the background art discussed above are overcome by the present invention. With this invention, a high heat filter fabric is disclosed which is a sliver knit fabric made with novel materials with the construction of the fabric and the choice of the materials both being specifically designed to produce a filter fabric which will have both a high level of performance as a filter medium for removing fine particulates and a high capacity for operation in a high temperature ambient environment.

Prior to discussing the particulars of the high heat filter fabric of the present invention, it is helpful to briefly discuss the sliver knitting process used in the manufacture of the high heat filter fabric of the present invention. Generally, sliver knitting is a knitting process which locks individual pile fibers directly into the cells of a lightweight knit backing in a manner where the pile fibers extend from a front side of the knit backing. The knit backing itself is made from yarn, which may be knit in a single jersey circular knitting process on a circular knitting machine, with tufts of the fibers being knit into the cells of the knit backing to retain them in the completed pile fabric.

The components of the knitted fabric are a yarn, which is used to knit the fabric's backing, and fibers which are supplied in a "sliver" rope, which consists of fibers which are all longitudinally oriented in a rope which is typically three inches in diameter. The fibers are loose fibers of either a single type or a uniform blend of multiple types of fibers. The fiber mix will determine the performance, density, texture, weight, patterning, and color of the finished pile fabric.

The fibers are typically blown together in an air chamber to blend them, and then are carded in carding machines that "comb" the fibers to align them in parallel with each other. The fibers are then gathered into a soft, thick rope which is called "sliver" (which is the derivation for the term "sliver knit") or "roving." The yarn and the sliver are supplied to the knitting machine, which typically has eighteen heads and produces a tubular knit pile fabric which is approximately fifty-eight inches in circumference. (Thus, when the tubular knit pile fabric is slit longitudinally, the fabric is approximately fifty-eight inches wide.)

Such knitting machines are well known in the art, and are illustrated in U.S. Pat. Nos. 5,431,029, 5,546,768, 5,577,402, and 5,685,176, all to Kukrau et al., and U.S. Pat. No. 6,151,920, to Schindler et al., all of which are hereby incorporated herein by reference. Examples of commercial versions of such knitting machines are the Model SK-18 II Sliver Knitter and the Model SK-18J II Sliver Knitter which are available from Mayer Industries, Inc. of Orangeburg, S.C.

The yarn which is used in the high heat filter fabric of the present invention is a high heat resistant yarn which is preferably made of an aramid material. In the preferred embodiment, the yarn is made of meta-aramid fibers rather than being made of para-aramid fibers, of which the preferred meta-aramid fiber is the meta-aramid fiber branded with the trademark CONEX, which is made by the Teijin Kabushiki Kaisha Corporation of Osaka, Japan. The preferred yarn is 13/1 CC yarn, meaning that it takes thirteen skeins of yarn (each 840 yards long) to make up one pound of the yarn. The yarn is made of fibers which are each approximately two inches long.

The fibers used in the sliver are high heat resistant fibers, and are preferably also made of an aramid material. In the preferred embodiment, the fibers used in the sliver are a blend which is between twenty and one hundred percent meta-aramid fibers, of which the preferred meta-aramid fiber is again the meta-aramid fiber branded with the trademark CONEX which is made by the Teijin Kabushiki Kaisha Corporation of Osaka, Japan, with the balance of the fibers being another type of aramid fiber. In the most preferred embodiment, the fibers used in the sliver are approximately sixty percent meta-aramid fibers, preferably the meta-aramid fiber branded with the trademark CONEX, and forty percent other aramid fibers. The preferred fibers used in the sliver are approximately two inches in length.

Following the knitting of the pile fabric of the present invention, the tubular knit pile fabric is slit to produce a roll of knit pile fabric. The pile side of the knit pile fabric (the side of the knit pile fabric from which the pile extends) is then sheared to a uniform height, which may be approximately one inch. The back side of the sheared knit pile fabric (the side of the knit pile fabric opposite the side from which the pile extends) is then coated with a light, thin, acrylic coating or binder which locks the fibers into the knit backing and provides stability to the high heat filter fabric of the present invention. The coating is cured in an oven through which the coated knit pile fabric passes.

In the preferred embodiment, the coating or binder which is used is a blend of a self-crosslinking acrylic emulsion for textiles and a thermosetting aqueous acrylic solution polymer binder which has a higher temperature resistance than the self-crosslinking acrylic emulsion. Preferably, the blend includes between ten and sixty percent of the thermosetting aqueous acrylic solution polymer binder, with the most preferred blend including approximately twenty-five percent of the thermosetting aqueous acrylic solution polymer binder. The thermosetting aqueous acrylic solution polymer binder may be TSET #1 Resin from Rohm and Haas Company, and the self-crosslinking acrylic emulsion may be RHOPLEX E-2780, also from Rohm and Haas Company.

The high heat filter fabric of the present invention is provided to filter manufacturers, which typically manufacture bags with the high heat filter fabric in which the pile side of the high heat filter fabric typically faces inwardly (although it could face outwardly in some applications). The high heat filter bags may then be utilized to remove fine particulates and dust from a hot gas stream. High heat filter bags made from the high heat filter fabric of the present invention perform well to remove fine particles and dust from a hot gas stream, and may be used in a high ambient heat environment without problems. The high heat filter bags may be cleaned to remove the particulates and dust and reused, and have an extended life.

In the first embodiment of the high heat filter fabric of the present invention, each of the cells in the knit backing is filled with pile fibers from the sliver. Two alternate embodiment high heat filter fabrics are also contemplated by the present invention. In each of these two alternate embodiment high heat filter fabrics, some of the cells in the knit backing do not have pile fibers from the sliver knit into them. In addition to leaving some of the cells in the knit backing unfilled, the cells in the knit backing that are filled with pile fibers from the sliver have a greater number of pile fibers knit into them, such that the weight of the resulting high heat filter fabric will be the same as the weight of the high heat fabric of the first embodiment. This results in the pile having the same density, but with the backing having open cells to facilitate the flow of the filtered hot gas stream therethrough.

The first alternate embodiment leaves some rows empty, and may be accomplished by leaving some of the heads in the sliver knitting machine empty so that they are not inserting pile fibers from the sliver into the row of cells which they would otherwise weave pile fibers into. For example, if a conventional eighteen-head sliver knitting machine is being used to manufacture the high heat filter fabric, every other row can be omitted (or alternately every third row, every sixth row, or every ninth row). The second alternate embodiment leaves some cells empty in a checkerboard fashion, and may be accomplished by the use of a pattern knitting machine. For example, every other cell can be left unfilled (or every third cell, every fourth cell, etc.).

It may therefore be seen that the present invention teaches a high heat filter fabric which is suitable for use in dust and/or particulate filters that will be used in high temperature ambient operating environments. The high heat filter fabric of the present invention is highly efficient as a filter medium at the removal of fine particulates which are as small as or possibly even smaller than 2.5 microns. The high heat filter fabric of the present invention is capable of continuous operation in an environment wherein the ambient temperature is typically in excess of 400 degrees Fahrenheit.

The high heat filter fabric of the present invention is also be capable of operating in high temperature environments without experiencing any significant degradation of the filter fabric material. The high heat filter fabric of the present invention is reusable after periodic cleaning to remove particulates which have been trapped by the filter medium. The high heat filter fabric of the present invention works as a filter medium with any of a wide variety of different high temperature air pollution abatement technologies, including (but not limited to) both lime injection and activated carbon injection. In either of two alternate embodiments, the high heat filter fabric of the present invention also provides a sufficiently high degree of airflow therethrough to function properly even in very high airflow environments without significantly reducing the degree of filtration afforded.

The high heat filter fabric of the present invention is a durable and long lasting material, and filter bags made from the high heat filter fabric of the present invention will thus require only cleaning to be provided by the user throughout their operating lifetime. The high heat filter fabric of the present invention is also inexpensive to manufacture, thereby enhancing its market appeal and affording it the broadest possible market. Finally, all of the aforesaid advantages and objectives of the high heat filter fabric of the present invention are achieved without incurring any substantial relative disadvantage.

DESCRIPTION OF THE DRAWINGS

These and other advantages of the present invention are best understood with reference to the drawings, in which.

DETAILED DESCRIPTION OF THE PREFERRED EMBODIMENT

The preferred embodiment of the high heat filter fabric of the present invention is a sliver knit fabric which is made with materials which are designed to provide both a top-notch level of performance as a filter media and the ability to be utilized in an ambient environment which is very hot, such as the environment of the exhaust stream of a power plant. As such, there are two aspects to the high heat filter fabric of the present invention which are combined to produce the high heat filter fabric—the sliver knit manufacturing process in which yarn, fibers, and a coating material are used to produce the high heat filter fabric itself, and the selection and combination of the materials which are used in the high heat filter fabric. These two aspects of the high heat filter fabric of the present invention will be discussed in detail below.

Figure 1:
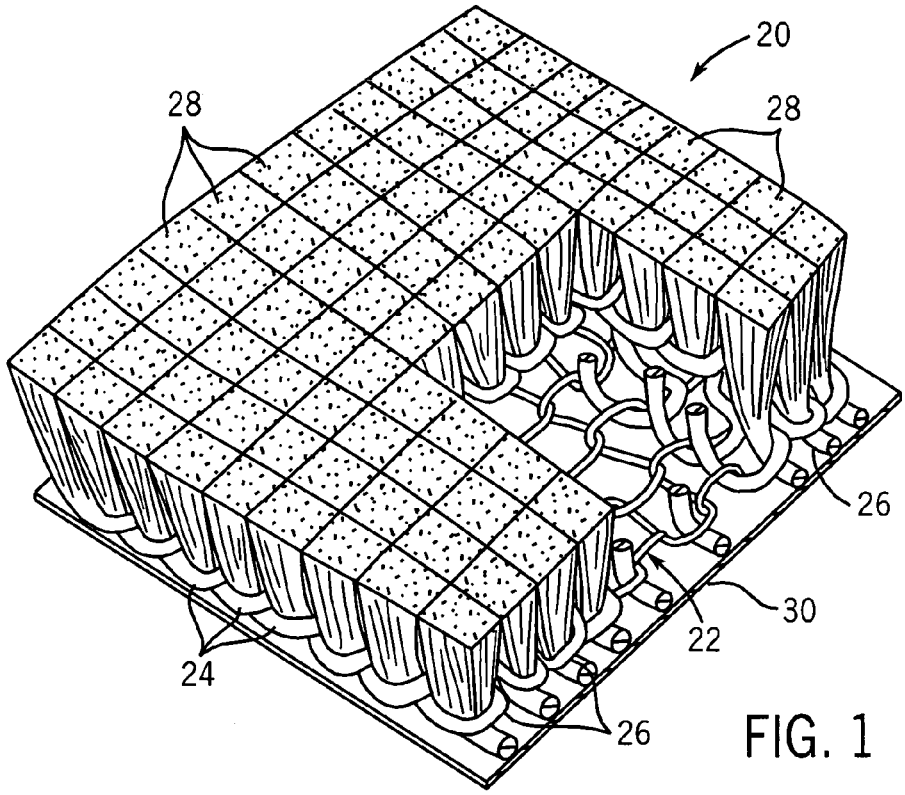
FIG. 1 is an isometric view of a segment of a first sliver knit filter fabric which is manufactured according to the teachings of the present invention, with some of the pile tufts removed to show the knit backing.

Referring first to FIG. 1, a segment of the sliver knit pile fabric 20 of the present invention is illustrated, with a number of pile tufts removed for added clarity and understanding of the construction of the pile fabric 20. The foundation of the pile fabric 20 is a knit backing 22, which is knit in a single jersey circular knitting process on a circular knitting machine. The jersey knitted knit backing 22 has a plurality of courses 24 (which are rows of loops of stitches which run across the knit fabric) and a plurality of wales 26 (which are vertical chains of loops in the longitudinal direction of the knit fabric). Each stitch loop in each wale forms a single cell in the knit backing through which pile fibers will be knit in the first embodiment of the high heat filter fabric of the present invention. In the first embodiment, the stitch count (per inch) is between approximately fourteen and approximately thirty-six, with approximately sixteen being the preferred number of stitches, and the wale count (per inch) is between approximately ten and approximately fourteen, with approximately fourteen being the preferred number of wales.

The knitting of the stitches of the knit backing 22 is used to anchor a plurality of tufts 28 of sliver fibers, with the free ends of the tufts 28 of fibers extending from a cell in one side of the knit backing 22, which is typically referred to as the front side of the pile fabric 20. Although the outermost ends of the tufts 28 of fibers are shown as presenting a uniform surface, those skilled in the art will appreciate that as the pile fabric 20 is knit, the height of the outermost ends of the tufts 28 of fibers will vary somewhat.

On the side of the knit backing 22 opposite the front side from which the ends of the tufts 28 of fibers project, which is typically referred to as the rear side of the pile fabric 20, a coating or binder 30 is applied to lock the tufts 28 of fibers into the knit backing 22 and provides stability to the pile fabric 20 of the present invention. The coating 30 is a latex or acrylic material which is spread (typically by knifing it on) onto the back side of the knit backing 22, and cured as the knit backing 22 is passed through an oven.

To a high degree, the high heat filter fabric of the present invention differs from the prior art in its use of materials, and in the characteristics and dimensions of the materials, in order to provide both the high level of performance it has as a filter media and its ability to be utilized in a very hot ambient environment such as in the exhaust stream of a power plant. The selection of each of the materials and the other characteristics of each of the components of the high heat filter fabric of the present invention will now be discussed in detail.

Referring first to the knit backing 22, the yarn which is used in the knit backing 22 of the present invention is a high heat resistant yarn which is made of a heat resistant material, preferably an aramid material. In the preferred embodiment, the yarn used for the knit backing 22 is made of meta-aramid fibers rather than para-aramid fibers, and the preferred meta-aramid fiber is the meta-aramid fiber branded with the trademark CONEX, which is manufactured by the Teijin Kabushiki Kaisha Corporation of Osaka, Japan. Other meta-aramid fibers which could instead be used instead of fiber branded with the trademark CONEX are fiber branded with the trademark NOMEX which is manufactured by DuPont, Wilmington, Del., and yarn branded with the trademark P84, which has a multi-lobal cross-section and is manufactured from meta-aramid fiber using a patented spinning method by Inspec Fibres GmbH, Lenzing, Austria.

The preferred yarn used to knit the knit backing 22 is 13/1 CC yarn, meaning that it takes thirteen skeins of yarn (each 840 yards long) to make up one pound of the yarn, although the range of yarn weights may vary from approximately 6/1 CC yarn to approximately 20/1 CC yarn. The yarn is made of fibers which are approximately two denier (a denier is a yarn count unit, with the number of deniers being the weight in grams of 9000 meters of the fiber), and which are each approximately two inches long.

The range in fiber size is from approximately 0.9 denier to approximately five denier, and the fiber length may vary from approximately one inch to approximately four inches. The yarn is made from a sliver which is fed into a machine with rollers that draw out the strands, making them longer and thinner, and spindles that insert the amount of twist necessary to hold the fibers together. It is Z-twist yarn, meaning that the strands assume an ascending left to right configuration, as in the central portion of the letter "Z." Such yarn may be purchased from Patrick Yarn Mills, Inc. in Kings Mountain, N.C.

Referring next to the tufts 28 of fibers, the fibers which are used in the tufts 28 of the present invention are high heat resistant fibers which are made of a heat resistant material, preferably an aramid material. In the preferred embodiment, the fibers used for the tufts 28 are made of a blend of meta-aramid fibers with other aramid fibers. The preferred meta-aramid fibers are the meta-aramid fibers branded with the trademark CONEX which are manufactured by Teijin. Other meta-aramid fibers which could instead be used instead of fibers branded with the trademark CONEX are fibers branded with the trademark NOMEX manufactured by DuPont and fibers used in the yarn branded with the trademark P84 manufactured by Inspec Fiber. The other aramid fibers which are blended with the meta-aramid fibers may be recycled aramid fibers on any of a number of different kinds.

The meta-aramid fibers used in the blend of fibers used in the tufts 28 are preferably between approximately two and approximately three denier (approximately two denier is preferred), and which are each approximately two inches long. The outer range in meta-aramid fiber size is between approximately 0.9 and approximately five denier, with better performance believed to be in the preferred range. The length of the meta-aramid fibers can vary between approximately one and one-half inches and approximately three inches. The aramid fibers used in the blend of fibers used in the tufts 28 are approximately three denier or less, and which are each approximately two inches long.

The outer range in aramid fiber size is also between approximately 0.9 and approximately five denier, with better performance believed to occur with fiber size of approximately three denier or less. The length of the aramid fibers can vary between approximately one and one-half inches and approximately three inches. As mentioned above, the aramid fibers used in the blend of fibers used in the tufts 28 may be recycled fibers.

In order to give the fibers used in the tufts 28 the required degree of heat resistance, the blend of fibers used in the tufts 28 must include at least approximately twenty percent meta-aramid fibers, and may include up to one hundred percent meta-aramid fibers. In the preferred embodiment, approximately sixty percent of the fibers used in the blend for the tufts 28 are meta-aramid fibers. Such a mixture of fibers may be purchased from Patrick Yarn Mills, Inc. in Kings Mountain, N.C.

The coating 30 used to bind the back of the knit backing 22 and retain the tufts 28 of fibers in place in the knit backing 22 is formulated to be more heat resistant than a conventional binding material used in textiles and nonwovens. Such a conventional binding material is RHOPLEX E-2780 self-crosslinking acrylic emulsion for textiles (Material No. 10081044), which is manufactured by Rohm and Haas Company of Philadelphia, Pa. In the preferred embodiment, the coating 30 used in the high heat filter fabric of the present invention is a blend of RHOPLEX E-2780 self-crosslinking acrylic emulsion for textiles and a thermosetting aqueous acrylic solution polymer binder which has a higher temperature resistance than the self-crosslinking acrylic emulsion.

One such thermosetting aqueous acrylic solution polymer binder is TSET #1 Resin (Material No. 10049338) from Rohm and Haas Company. In the preferred embodiment, the blend of the self-crosslinking acrylic emulsion for textiles and the thermosetting aqueous acrylic solution polymer binder includes between ten and sixty percent of the thermosetting aqueous acrylic solution polymer binder. Including less of the thermosetting aqueous acrylic solution polymer binder will result in unacceptable heat tolerance characteristics, and using more of the thermosetting aqueous acrylic solution polymer binder will result in an unsatisfactory pile fabric. The amount of the thermosetting aqueous acrylic solution polymer binder which is believed to be optimal is approximately twenty-five percent.

The manufacture of the high heat filter fabric of the present invention may now be discussed with reference to the flow diagram of FIG. 2. The manufacturing process begins with the pile fibers 40, which as mentioned above include the meta-aramid fibers and the other aramid fibers (which may be recycled aramid fibers). The pile fibers 40 are blended in a the fiber blending step 42, which is typically performed by blowing the meta-aramid fibers and the other aramid fibers together in the desired ratio in an air chamber to blend the meta-aramid fibers and the other aramid fibers into a uniform mixture of fibers.

The mixed fibers are then sent through a series of special carding machines which are well known to those skilled in the art to comb the mixed fibers in a fiber carding step 44, thereby aligning the mixed fibers parallel to one another. The aligned mixed fibers are then gathered into the soft sliver rope 46, which as mentioned previously is approximately three inches in diameter.

The sliver rope 46 and the yarn 48, which as mentioned above is preferably made of meta-aramid fibers, are supplied to a knitting machine which performs a knitting step 50. As mentioned above, the knitting machine may be a Model SK-18 II Sliver Knitter or a Model SK-18J II Sliver Knitter which are available from Mayer Industries, Inc., or a similar machine from another manufacturer. In the preferred embodiment, the knitting step 50 uses eighteen yarns 48 and produces a plain pile 14 cut (this refers to the cylinder size on the knitting machine, and is the number of wales per inch) with twenty-four stitches per lineal inch.

The master density is approximately 24.5, and the target weight of the pile fabric 20 is approximately 1.32 pounds per yard (the knitting machine produces a produces a tubular knit pile fabric which is approximately fifty-eight inches in circumference). Note that by decreasing the amount of pile fibers which go into the high heat filter fabric, by decreasing the length of the pile in the high heat filter fabric, or by increasing the denier (thickness) of the pile fibers, the amount of air which will flow through a filter made of the high heat filter fabric will be increased.

The tubular knit pile fabric is slit longitudinally as it comes off of the knitting machine in a slitting step 52, which is typically performed by the knitting machine. The slit knit pile fabric is typically rolled up, and then is sent through a shearing machine in a shearing step 54 to bring the pile fibers to a uniform length. In the preferred embodiment, the pile fibers are clean sheared to an approximately one inch height.

Unlike the process used in the manufacture of many knit pile fabrics, the high heat filter fabric of the present invention is not subjected to a finishing process (which is used to apply a sheen to knit pile fabrics). If desired, the fabric may be stretched before being coated to increase the sizes of the cells, with the stretching being done either laterally to effectively decrease the stitch count or lengthwise to effectively decrease the wale count, or in both directions. This will increase the airflow through any filter made with the high heat filter fabric.

Next, the coating 30, which is a blend of the self-crosslinking acrylic emulsion for textiles and the thermosetting aqueous acrylic solution polymer binder, is applied by spreading (the coating 30 is typically knifed on) it onto the sheared, slit knit pile fabric in a coating step 56. The coated, sheared, slit knit pile fabric is then sent through an oven to cure the coating 30. In the preferred embodiment, the curing operation is performed at a temperature of approximately 310 degrees Fahrenheit and at a speed of approximately sixteen yards per minute (transit time through the oven typically takes approximately one minute to one and a half minutes).

Note that by varying the amount of coating applied to the pile fabric the amount of air which will flow through a filter made with the high heat filter material will also vary, with a decreased amount of coating resulting in a marginally increased airflow. The cured, coated, sheared, slit knit pile fabric may then be inspected for quality in an inspection step 58. This completes the manufacture of the first embodiment of the high heat filter fabric of the present invention in which each of the cells in the knit backing 22 is filled with pile fibers from the sliver. One potential additional step which may be performed is running the face (the pile side) of the high heat filter fabric over heated cylinders, which will straighten out the pile fibers, decreasing the number of crimps or bents in them to result in a "softer hand" on the face of the high heat filter fabric.

As mentioned previously, there are two alternate embodiments which are contemplated by the present invention for applications in which the first embodiment of the high heat filter fabric of the present invention is unsuitable due to the necessity for a higher air flow therethrough. In each of these two alternate embodiments, a number of the cells in the knit backing will not be filled with pile fibers from the sliver, but rather will be left empty. In both of the two alternate embodiment high heat filter fabrics of the present invention, the cells in the knit backing that are filled with pile fibers from the sliver have a greater number of pile fibers knit into them, such that the weight of the resulting high heat filter fabric will be the same as the weight of the high heat fabric of the first embodiment. As such, the alternate embodiment high heat filter fabrics of the present invention each offer performance which is virtually identical to the performance of the first embodiment high heat filter fabric of the present invention.

Figure 3:
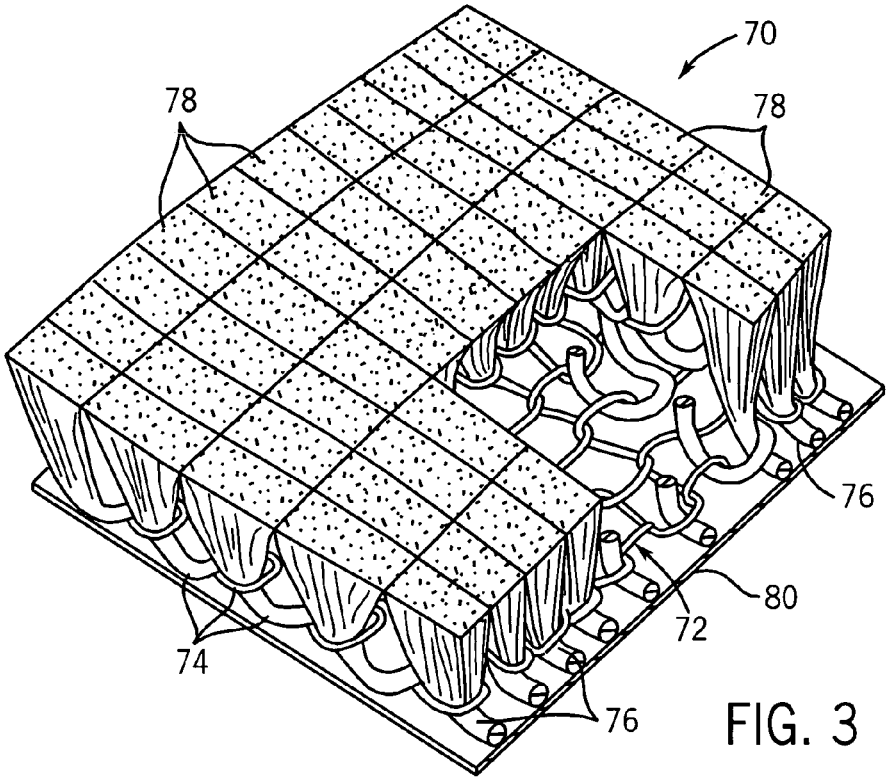
FIG. 3 is an isometric view of a segment of a second sliver knit filter fabric having an increased airflow capacity which is manufactured according to the teachings of the present invention in a first alternate manner, with some of the pile tufts removed to show the knit backing.

Referring first to FIG. 3, a first alternate embodiment sliver knit pile fabric 70 is illustrated, with a number of pile tufts removed for added clarity and understanding of the construction of the pile fabric 70. The foundation of the pile fabric 70 is a knit backing 72, which is knit in a single jersey circular knitting process on a circular knitting machine. The jersey knitted knit backing 72 has a plurality of courses 74 and a plurality of wales 76. Each stitch loop in each wale forms a single cell in the knit backing. Like the first embodiment, the first alternate embodiment pile fabric 70 the stitch count (per inch) is approximately sixteen, and the wale count is approximately fourteen.

The knitting of the stitches of the knit backing 72 is used to anchor a plurality of tufts 78 of sliver fibers, with the free ends of the tufts 78 of fibers extending from a cell in one side of the knit backing 72, which is typically referred to as the front side of the pile fabric 70. The tufts 78 are knit into the pile fabric 70 in alternating rows (the tufts 79 are installed in every other wale of the pile fabric 70). This may be accomplished in a conventional sliver knitting machine by leaving alternating heads empty so that they are not supplying roving to the cells in alternate rows. Thus, for an eighteen-head sliver knitting machine, either the even heads or the odd heads are empty. Even with alternate rows empty, the outermost ends of the tufts 78 of fibers will present a relatively uniform surface since each of the tufts 78 will have essentially double the fibers used in the tufts 28 of the first embodiment (shown in FIG. 1). This results in the pile fabric 70 having the same weight as the pile fabric 20 (shown in FIG. 1).

On the rear side of the knit backing 72 (the side opposite the front side from which the ends of the tufts 78 of fibers project) a coating or binder 80 is applied to lock the tufts 78 of fibers into the knit backing 72 and provide stability to the pile fabric 70 of the present invention. The coating 80 is again a latex or acrylic material which is spread (typically by knifing it on) onto the back side of the knit backing 72, and cured as the knit backing 72 is passed through an oven.

The yarn used in the knit backing 72 is the same high heat resistant yarn used for the knit backing 22 in the first embodiment (shown in FIG. 1). The fibers which are used in the tufts 78 are the same high heat resistant fibers used for the tufts 28. The coating 80 is the same type of heat resistant binding material used in the first embodiment. The coating, shearing, slitting, and curing of the knit pile fabric 70 is the same as that used for the pile fabric 20 of the first embodiment. This completes the discussion of the first alternate embodiment of the high heat filter fabric of the present invention in which every other row of cells in the knit backing 72 is filled with pile fibers from the sliver. Those skilled in the art will appreciate that while the embodiment shown omits every other row of pile fibers, alternately every third row, every sixth row, or every ninth row, for example, could instead be omitted.

Figure 4:
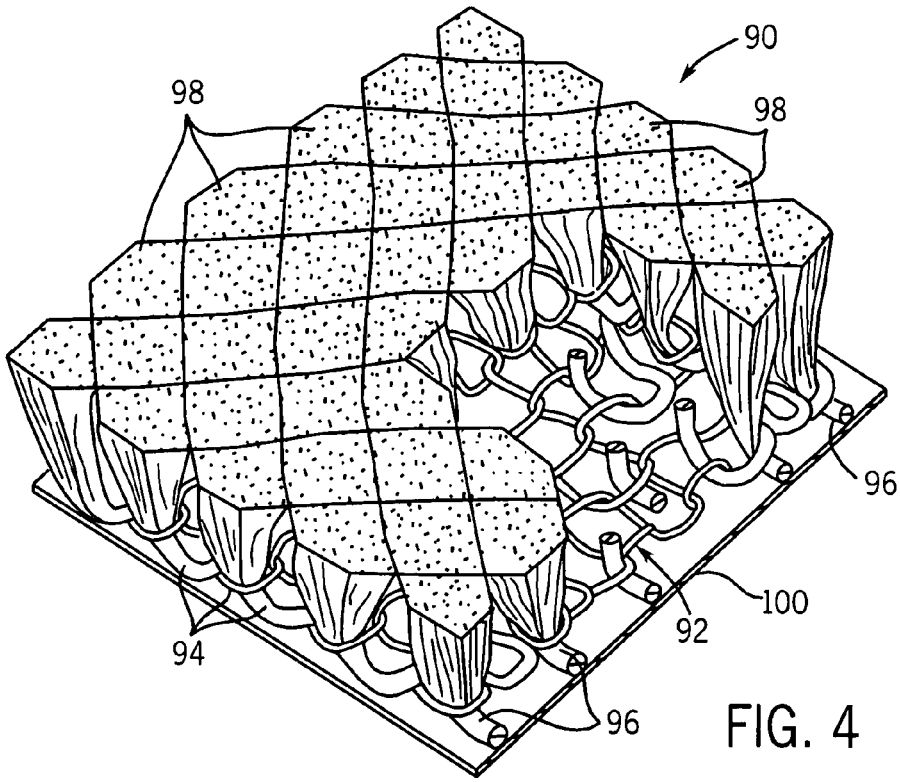
FIG. 4 is an isometric view of a segment of a third sliver knit filter fabric having an increased airflow capacity which is manufactured according to the teachings of the present invention in a second alternate manner, with some of the pile tufts removed to show the knit backing.

Referring next to FIG. 4, a second alternate embodiment sliver knit pile fabric 90 is illustrated, with a number of pile tufts removed for added clarity and understanding of the construction of the pile fabric 90. The foundation of the pile fabric 90 is a knit backing 92, which is knit in a single jersey circular knitting process on a circular knitting machine. The jersey knitted knit backing 92 has a plurality of courses 94 and a plurality of wales 96. Each stitch loop in each wale forms a single cell in the knit backing. Like the first embodiment, the second alternate embodiment pile fabric 90 the stitch count (per inch) is approximately sixteen, and the wale count is approximately fourteen.

The knitting of the stitches of the knit backing 92 is used to anchor a plurality of tufts 98 of sliver fibers, with the free ends of the tufts 98 of fibers extending from a cell in one side of the knit backing 92, which is typically referred to as the front side of the pile fabric 90. The tufts 98 are knit into the pile fabric 90 in checkerboard fashion (the tufts 99 are installed in every other cell in each row of the pile fabric 90, with empty cells in consecutive rows being offset). This may be accomplished in a pattern sliver knitting machine, which allows the selection of which needles input sliver into any particular cell. Even with every other cell being empty, the outermost ends of the tufts 98 of fibers will present a relatively uniform surface since each of the tufts 98 will have essentially double the fibers used in the tufts 28 of the first embodiment (shown in FIG. 1). This results in the pile fabric 90 having the same weight as the pile fabric 20 (shown in FIG. 1).

On the rear side of the knit backing 92 (the side opposite the front side from which the ends of the tufts 98 of fibers project) a coating or binder 100 is applied to lock the tufts 98 of fibers into the knit backing 92 and provide stability to the pile fabric 90 of the present invention. The coating 100 is again a latex or acrylic material which is spread (typically by knifing it on) onto the back side of the knit backing 92, and cured as the knit backing 92 is passed through an oven.

The yarn used in the knit backing 92 is the same high heat resistant yarn used for the knit backing 22 in the first embodiment (shown in FIG. 1). The fibers which are used in the tufts 98 are the same high heat resistant fibers used for the tufts 28. The coating 100 is the same type of heat resistant binding material used in the first embodiment. The coating, shearing, slitting, and curing of the knit pile fabric 90 is the same as that used for the pile fabric 20 of the first embodiment. This completes the discussion of the second alternate embodiment of the high heat filter fabric of the present invention in which alternating cells in the knit backing 92 are filled with pile fibers from the sliver. Those skilled in the art will appreciate that while the embodiment shown omits pile fibers from every other cell, alternately every third cell, every fourth cell, etc., could instead be omitted.

Figure 2:
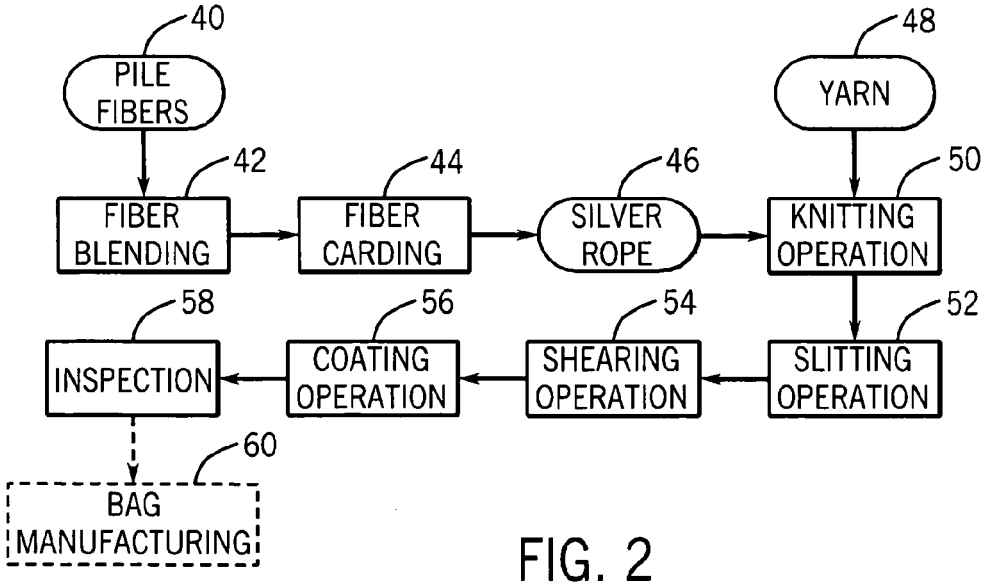
FIG. 2 is a flow diagram which illustrates the manufacturing process used by the present invention to manufacture the sliver knit filter fabric illustrated in FIG. 1.

The high heat filter fabric of the present invention may be sold to filter manufacturers, which typically manufacture bags (as shown in FIG. 2 in a bag manufacturing step 60) with the front side of the high heat filter fabric which has the pile extending therefrom facing inwardly. The resulting high heat filter bags may then be sold to end users, and utilized to remove fine particulates and dust from a high temperature gas stream. The high heat filter bags which are made from the high heat filter fabric of the present invention exhibit excellent performance characteristics in the removal of fine particles and dust from a hot gas stream, and may be utilized in high ambient heat environments without problems. The high heat filter bags may periodically be cleaned to remove the particulates and dust therefrom, following which they may be reused a number of times before reaching the end of their effective life.

It may therefore be appreciated from the above detailed description of the preferred embodiment of the present invention that it teaches a high heat filter fabric which is suitable for use in dust and/or particulate filters that will be used in high temperature ambient operating environments. The high heat filter fabric of the present invention is highly efficient as a filter medium at the removal of fine particulates which are as small as or possibly even smaller than 2.5 microns. The high heat filter fabric of the present invention is capable of continuous operation in an environment wherein the ambient temperature is typically in excess of 400 degrees Fahrenheit.

The high heat filter fabric of the present invention is also be capable of operating in high temperature environments without experiencing any significant degradation of the filter fabric material. The high heat filter fabric of the present invention is reusable after periodic cleaning to remove particulates which have been trapped by the filter medium. The high heat filter fabric of the present invention works as a filter medium with any of a wide variety of different high temperature air pollution abatement technologies, including (but not limited to) both lime injection and activated carbon injection. In either of two alternate embodiments, the high heat filter fabric of the present invention also provides a sufficiently high degree of airflow therethrough to function properly even in very high airflow environments without significantly reducing the degree of filtration afforded.

The high heat filter fabric of the present invention is a durable and long lasting material, and filter bags made from the high heat filter fabric of the present invention will thus require only cleaning to be provided by the user throughout their operating lifetime. The high heat filter fabric of the present invention is also inexpensive to manufacture, thereby enhancing its market appeal and affording it the broadest possible market. Finally, all of the aforesaid advantages and objectives of the high heat filter fabric of the present invention are achieved without incurring any substantial relative disadvantage.

Although the foregoing description of the present invention has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

What is claimed is:

1. A fabric suitable for use in the manufacture of filters which will be used in a high ambient temperature environment, the fabric comprising:

a knit backing which is knitted from a heat resistant aramid yarn, said knit backing defining a plurality of cells and a front side and a back side;

individual pile fibers which are made of a heat resistant aramid material and which are knitted into cells in said knit backing, said pile fibers extending outwardly from said front side of said knit backing to form a pile on said front face of said knit backing, wherein said pile fibers are knit into some, but not all, of said cells in said knit backing; and a polymeric coating on said back side of said knit backing which is made of a heat resistant material.

2. A fabric as defined in claim 1, wherein said fabric is a sliver knit fabric.

3. A fabric as defined in claim 2, wherein said sliver knit fabric is knit in a single jersey circular knitting process.

4. A fabric as defined in claim 1, wherein said heat resistant aramid yarn comprises:

meta-aramid fibers.

5. A fabric as defined in claim 1, wherein said heat resistant aramid yarn weight is between approximately 6/1 CC yarn to approximately 20/1 CC yarn.

6. A fabric as defined in claim 5, wherein said heat resistant aramid yarn weight is approximately 13/1 CC yarn.

7. A fabric as defined in claim 1, wherein said heat resistant aramid yarn is made of fibers of a size which is between approximately 0.9 denier and approximately five denier.

8. A fabric as defined in claim 7, wherein said heat resistant aramid yarn is made of fibers of a size which is approximately two denier.

9. A fabric as defined in claim 1, wherein said heat resistant aramid yarn is made of fibers which are each between approximately one inch long and approximately four inches long.

10. A fabric as defined in claim 9, wherein said heat resistant aramid yarn is made of fibers which are each approximately two inches long.

11. A fabric as defined in claim 1, wherein said heat resistant aramid yarn is a Z-twist yarn.

12. A fabric as defined in claim 1, wherein said pile fibers comprises:

meta-aramid fibers; and aramid fibers.

13. A fabric as defined in claim 12, wherein between approximately twenty percent and approximately one hundred percent of said pile fibers are meta-aramid fibers, with the balance of said pile fibers being said aramid fibers.

14. A fabric as defined in claim 13, wherein approximately sixty percent of said pile fibers are meta-aramid fibers, with the balance of said pile fibers being said aramid fibers.

15. A fabric as defined in claim 12, wherein said aramid fibers which are not meta-aramid fibers comprise:

recycled aramid fibers.

16. A fabric as defined in claim 12, wherein said meta-aramid fibers are of a size which is between approximately two denier and approximately three denier.

17. A fabric as defined in claim 12, wherein said meta-aramid fibers are of a size which is approximately two denier.

18. A fabric as defined in claim 12, wherein said aramid fibers are of a size which is approximately three denier or less.

19. A fabric as defined in claim 1, wherein said pile fibers are each approximately two inches long.

20. A fabric as defined in claim 1, wherein said pile fibers are sheared to a pile height of approximately one inch after they have been knit into said knit backing.

21. A fabric as defined in claim 1, wherein said polymeric coating comprises:

a self-crosslinking acrylic emulsion for textiles; and a thermosetting aqueous acrylic solution polymer binder.

22. A fabric as defined in claim 21, wherein between approximately ten percent and approximately sixty percent of said polymeric coating is said thermosetting aqueous acrylic solution polymer binder, with the balance of said polymeric binder being said self-crosslinking acrylic emulsion for textiles.

23. A fabric as defined in claim 22 the knit backing, wherein approximately twenty-five percent of said polymeric coating is said thermosetting aqueous acrylic solution polymer binder, with the balance of said polymeric binder being said self-crosslinking acrylic emulsion for textiles.

24. A fabric as defined in claim 1, wherein said knit backing has approximately fourteen wales per inch and approximately sixteen stitches per lineal inch.

25. A fabric as defined in claim 1, wherein said fabric has a weight of approximately 1.32 pounds per yard and a width of approximately fifty-eight inches.

26. A fabric as defined in claim 1, at least one of every sixteen consecutive rows of said cells in said knit backing is empty and thereby does not have said pile fibers knit therein.

27. A fabric as defined in claim 26, wherein every other row of said cells in said knit backing is empty and thereby does not have said pile fibers knit therein.

28. A fabric as defined in claim 26, wherein every third row of said cells in said knit backing is empty and thereby does not have said pile fibers knit therein.

29. A fabric as defined in claim 26, wherein every sixth row of said cells in said knit backing is empty and thereby does not have said pile fibers knit therein.

30. A fabric as defined in claim 26, wherein every ninth row of said cells in said knit backing is empty and thereby does not have said pile fibers knit therein.

31. A fabric as defined in claim 1, wherein at least one of every five consecutive cells in each row of said knit backing is empty and thereby does not have said pile fibers knit therein, with empty cells in consecutive rows being offset.

32. A fabric as defined in claim 31, wherein every other consecutive cell in each row of said knit backing is empty and thereby does not have said pile fibers knit therein.

33. A fabric as defined in claim 31, wherein every third consecutive cell in each row of said knit backing is empty and thereby does not have said pile fibers knit therein.

34. A fabric suitable for use in the manufacture of filters which will be used in a high ambient temperature environment, the fabric comprising:

a knit backing which is knitted from a heat resistant meta-aramid yarn, said knit backing having a plurality of cells and a front side and a back side;

individual pile fibers which are a blend of meta-aramid fibers and other aramid fibers and which are knitted into cells in said knit backing, said pile fibers extending outwardly from said front side of said knit backing to form a pile on said front face of said knit backing, wherein at least one of every sixteen consecutive rows of said cells in said knit backing is empty and thereby does not have said pile fibers knit therein; and an acrylic coating on said back side of said knit backing which is made of a blend of a self-crosslinking acrylic emulsion for textiles and a thermosetting aqueous acrylic solution polymer binder.

35. A fabric suitable for use in the manufacture of filters which will be used in a high ambient temperature environment, the fabric comprising:

a knit backing which is knitted from a heat resistant yarn, said knit backing having a plurality of cells and a front side and a back side;

pile fibers which are made of a heat resistant material and which are knitted into cells in said knit backing, said pile fibers extending outwardly from said front side of said knit backing to form a pile on said front face of said knit backing, wherein said pile fibers are knit into some, but not all, of said cells in said knit backing; and a coating on said back side of said knit backing which is made of a heat resistant material.

36. A filter bag for use in a high ambient temperature environment, said filter bag being made from a fabric which comprises:

a knit backing which is knitted from a heat resistant aramid yarn, said knit backing having a plurality of cells and a front side and a back side;

individual pile fibers which are made of a heat resistant aramid material and which are knitted into cells in said knit backing, said pile fibers extending outwardly from said front side of said knit backing to form a pile on said front face of said knit backing, wherein said pile fibers are knit into some, but not all, of said cells in said knit backing; and a polymeric coating on said back side of said knit backing which is made of a heat resistant material.

37. A method of making a fabric suitable for use in the manufacture of filters which will be used in a high ambient temperature environment, the method comprising:

knitting a knit backing from a heat resistant aramid yarn, said knit backing having a plurality of cells and a front side and a back side;

knitting individual pile fibers which are made of a heat resistant aramid material into cells in said knit backing, said pile fibers extending outwardly from said front side of said knit backing to form a pile on said front face of said knit backing, wherein said pile fibers are knit into some, but not all, of said cells in said knit backing; and coating said back side of said knit backing with a polymeric coating which is made of a heat resistant material.

38. A method as defined in claim 29, additionally comprising:

shearing said pile to a uniform height.

* * * * *